United States Patent [19]

Svending

[11] Patent Number: 4,946,557

[45] Date of Patent: Aug. 7, 1990

[54] PROCESS FOR THE PRODUCTION OF PAPER

[75] Inventor: Per J. Svending, Kungalv, Sweden

[73] Assignee: Eka Nobel AB, Surte, Sweden

[21] Appl. No.: 315,349

[22] Filed: Feb. 24, 1989

Related U.S. Application Data

[63] Continuation-in-part of Ser. No. 165,635, Mar. 8, 1988, abandoned.

[51] Int. Cl.[5] ..... D21H 17/32; D21H 17/44; D21H 17/68

[52] U.S. Cl. ..... 162/168.3; 162/164.6; 162/175; 162/178; 162/181.6

[58] Field of Search ..... 162/177, 175, 181.1, 162/178, 168.3, 181.6, 164.6, 164.3, 168.2

[56] References Cited

U.S. PATENT DOCUMENTS

| | | | |
|---|---|---|---|
| 3,007,878 | 11/1961 | Alexander et al. | 252/313 |
| 3,620,978 | 11/1971 | Moore, Jr. | 252/313 |
| 3,719,607 | 3/1973 | Moore, Jr. | 252/313 |
| 3,956,171 | 5/1976 | Moore, Jr. et al. | 252/313 |
| 4,309,247 | 1/1982 | Hou et al. | 162/149 |
| 4,366,068 | 12/1982 | Ostricher et al. | 210/767 |

FOREIGN PATENT DOCUMENTS

| | | |
|---|---|---|
| 0041056 | 8/1984 | European Pat. Off. . |
| 85-260377 | 12/1985 | Japan . |
| 8605826 | 10/1986 | Sweden . |

*Primary Examiner*—Peter Chin

*Attorney, Agent, or Firm*—Burns, Doane, Swecker & Mathis

[57] ABSTRACT

A process for the production of paper by forming and dewatering a suspension of cellulose containing fibers and optional fillers on a wire in the presence of a cationic silica based sol and a cationic polymeric retention agent. The cationic polymeric retention agent is cationic guar gum or a cationic synthetic polymer such as cationic polyacrylamide. The combination of cationic silica sol and cationic polymer retention agent gives improved retention of fines and fillers and eases drainage.

7 Claims, No Drawings

PROCESS FOR THE PRODUCTION OF PAPER

This application is a continuation-in-part of application Ser. No. 165,635 filed Mar. 8, 1988 now abandoned.

The present invention relates to a process for the production of paper utilizing a combination of substances for improving retention and dewatering. More particularly the invention relates to the use of a combination of a cationic silica based sol and a cationic, organic, polymeric retention agent in papermaking.

It is previously known to use combinations of inorganic silica sols and cationic retention agents in papermaking. In these cases anionic silica sols have been used in combination with cationic polymeric retention agents, such as for example cationic starch and cationic polyacrylamide. Such systems are disclosed for example in the European patent No. 41056 and the European patent application No. 218674. The effect of systems comprising an anionic silica sol and a cationic component is based on the interaction of the two differently charged substances and it is assumed that the sol particles with their strong anionic charges to some degree produce a cross-linking of the polymeric retention agent.

Cationic inorganic silica based colloids are per se known and their use in specific paper making processes is also known. Thus the U.S. Pat. Nos. 4,309,247 and 4,366,068 disclose the use of cationic inorganic silica colloids in the preparation of filter media based on cellulose fibers. It is also known from the Japanese patent application No. 85260377 to use cationic collodial silica in ink jet recording paper to improve water resistance of water soluble dyes and to improve light resistance. In an example in the Japanese application the preparation of the ink jet recording paper from a pulp slurry containing talcum, cationic starch and cationic colloidal silica is shown.

According to the present invention it has unexpectedly been found that a combination of a cationic silica based sol and a cationic, organic, polymeric retention agent can be used in papermaking and that the combination of the two components of the same charge gives improved retention and dewatering. The combination according to the invention gives an improved retention of fine fibers and optional fillers and eases drainage and thereby makes the papermaking process more efficient.

The present invention thus relates to a process for the production of paper by forming and dewatering a suspension of cellulose containing fibers and optionally fillers on a wire whereby said formation and dewatering takes place in the presence of a cationic silica based sol and a cationic polymer retention agent selected from the groups cationic guar gum and cationic synthetic polymers.

Silica sols with positively charged particles are, as stated above, known per se and their preparation is disclosed for example in the U.S. Pat. Nos. 3,007,878, 3,620,978 and 3,719,607. The general methods for preparing cationic silica sols start from aqueous sols of silica which are reacted with a basic salt of a polyvalent metal to give the sol particles a positive surface charge and stabilizers such as boric acid, alkali metal bases, alkaline earth metal bases, ammonia etc are often used in the processes. The polyvalent metal salt is usually an aluminum salt, due to availability and lower costs, although it is of course also possible to use basic salts of other polyvalent metals for preparing cationic silica based sols, such as chromium, zirconium and others. Any basic salt which is water soluble and gives the desired positively charged surface can be used and generally the cationic sols are prepared using chlorides, nitrates or acetates of the metal.

The particles of the cationic sols have a small average particle size, usually below 100 nm and the size is generally in the range of from 2 nm to 100 nm, more often in the range of 2 nm to 80 nm. Suitably the particle size is within the range of from 3 to 20, and preferably from 3.5 to 14 nm. The cationic silica particles will have positively charged species of the polyvalent metal, preferably of aluminum, on their surfaces and the mole ratio of aluminum to surface silica can be within the range of from 1:8 to 4:1, suitably within the range of from 1:6 to 4:1 and preferably within the range of from 1:4 to 4:1. Most preferably the ratio is within the range of 1:2 to 4:1. The mole ratio of aluminum to surface silica has here been calculated as in U.S. Pat. No. 3,956,171, i.e. on basis of 8 silicon atoms per square nm of silica surface whereby the fraction of total silica occurring in the surface becomes $8\times10^{-4}\times A$, where A is the specific surface area of the sol particles in $m^2/g$. The cationic silica sols used according to the present invention can be prepared from any anionic silica sol by reaction with a basic salt of a polyvalent metal salt as above. They can thus be prepared from commercial sols of collodial silica and from silica sols consisting of polymeric silicic acid prepared by acidification of alkali metal silicate, for example by mixing mineral acid and water glass or by using acid ion exchange resins. The cationic silica is added to the stock in the form of an aqueous sol. The concentration in the cationic sol can be up to about 50 per cent by weight for sols made from commercial anionic silica sols and up to about 10 percent by weight when made from polysilicic acid. The stability of the last mentioned type of sols is limited and thus concentrations about or lower than 5 percent are suitable. The stability is generally higher if more aluminum is present, within the above ratios. From a practical point of view it is anyhow suitable to dilute the sols to a concentration of from 0.05 to 5.0 percent by weight of the cationic particles, preferably from 0.1 to 2 percent by weight, before addition to the stock.

The cationic retention agents which are used in combination with the cationic silica sols are at papermaking conventional organic, polymeric retention agents, which have a cationic net charge at the pH at which they are used, and they are either cationic guar gum or synthetic cationic polymers. Examples of suitable synthetic cationic polymers are cationic polyacrylamides, polyethyleneimines and polyamidoamines. A mixture of two or more cationic retention agents as above can also be used, and any of these can also be used in combination with cationic starch. Synthetic cationic retention agents are preferred, and particularly cationic polyacrylamide.

The amounts of cationic silica and of cationic retention agent which are used will of course depend on the particular stock, presence of fillers and other papermaking conditions. Usually amounts of from 0.005 to 2.0 percent by weight of the cationic silica, as dry, based on dry fibers and optional fillers give good results and the amounts suitably used are from 0.005 to 1 percent by weight. Amounts in the range of from 0.03 to 0.3 percent are preferred. The ratio of cationic retention agent to cationic silica will vary widely depending on for example the papermaking conditions, the particular cationic polymer and on other effects desired from this. Usually the weight ratio of cationic retention agent to cationic silica should be at least 0.01:1 and suitably at least 0.2:1. The upper limit of the cationic retention agent with lower cationicity such as guar gum is not critical and can for such cationic polymers be very high, up to a ratio of 100:1, and higher, and the limit is usually set by economical reasons. Ratios of cationic retention agent to cationic silica within the range of 0.2:1 to 20:1 are suitable for most systems.

The two-component system of the present invention can be used in papermaking from different types of stocks of papermaking fibers, suitably from stocks containing at least 50 percent by weight of cellulose containing fibers. The components can for example be used as additives to stocks from fibers from chemical pulp, such as sulphate and sulphite pulp, thermo-mechanical pulp, refiner mechanical pulp or groundwood pulp, from as well hardwood as softwood. The system of the invention can also advantageously be used for recycled fibers. As mentioned, the stock can also contain mineral fillers of conventional types, such as e.g. kaolin, titanium dioxide, gypsum, chalk and talcum. Particularly good results have been obtained with pulps which are generally considered as difficult and which contain fairly high amounts of non-cellulose substances such as lignin, i.e. different types of mechanical pulp such as groundwood pulp. The two component system of the invention is particularly suitable for stocks made up from at least 25 percent by weight of mechanical pulp and give a much improved effect in such systems compared with sols of anionic silica and a cationic retention agent. The terms paper and papermaking, which are used herein, do of course not only include paper and its production, but also other cellulose fiber containing sheet or web form products, such as pulp sheet, board and cardboard and their production.

The cationic silica sol and the cationic polymeric retention agent can be added to the stock separately, simultaneously or premixed. They can also be added in two or more increments. It is preferred that the two components are added separately. It seems that the order of addition of the sol and the cationic retention agent has some influence on the obtained effect and that when the sols contain smaller particles a better effect is obtained if the cationic retention agent is added before the sol of cationic silica, while for sols of larger particles a better effect generally is obtained when the cationic silica is added first and the cationic retention agent is added subsequently. The addition of cationic silica and cationic retention agent according to the invention considerably improves the retention of fines and fillers, when present, and also considerably improves the dewatering, in comparison with the use of solely the cationic retention agent. Smaller amounts of cationic polymer can thus be used for obtaining a desired effect and for expensive cationic polymers, such as polyacrylamide, important cost-savings can thus be made. Using the system of the invention the papermaking process can thus be made more efficient without negative effects on the strength and other important properties of the produced paper. The mechanisms contributing to the positive effect of the two component, which have the same charge, have not been entirely established, but it is believed that the cationic silica of the sol at least partly neutralizes dissolved anionic wood substances and that it also improves the strength of flock, formed from dissolved and solid components of the stock by the added cationic retention agent, by its capability of penetrating and chargewise neutralizing the flocks.

In the present process for production of paper conventional additives can of course be used in addition to the two additives according to the invention. Fillers have been discussed above, and as examples of other additives can be mentioned sizing agents, rosin based or synthetic sizing agents, cationic starch, wet strength resins and aluminum based compounds, such as alum, aluminate, aluminum chloride or polyaluminum compounds, can thus be used. The papermaking process using the present combination of substances for improved retention and dewatering can be carried out in a wide pH range, from about 4 to about 9. It is a special advantage that wood containing papers with high levels of fines content can be produced at high retention with the present system without adverse effects on paper formation.

The invention is further illustrated in the following examples which, however, are not intended to limit the same. Parts and percent relate to parts by weight and percent by weight respectively, unless otherwise stated.

EXAMPLE 1

The cationic silica sols used in Examples 1 and 2 were prepared as follows. Aluminum chlorohydrate, with the formula $Al_2(OH)_5Cl.2H_2O$, was heated to 47° C. under stirring in a flask equipped with a heating jacket. When the temperature had been reached anionic silica sols, deionized with regard to sodium ions, which has been diluted with deionized water were added for a certain time to allow reaction with the aluminum chlorohydrate. As a more specific preparation procedure the following is typical: 408 g 50% $Al_2(OH)_5Cl.2H_2O$ solution was warmed to 47° C. 657 g of anionic silica sol containing 15.21% $SiO_2$ were diluted with 928 g deionized water. The particles of this sol had a size of about 7 nm. The sol was added for 90 minutes at 47° C. and the obtained cationic sol was then allowed to cool to room temperature.

In the following tests the dewatering was evaluated with a "Canadian Freeness Tester" which is the usual method for characterizing the dewatering or drainage capability according to SCAN-C 21:65.

The stock system was composed of 60% bleached birch sulphate pulp and 40% bleached pin sulphate pulp and 30% of China clay had been added to the system. The chemical additions are calculated in kg per ton dry stock system (fibre+filler) and the amounts of sols and cationic polymers are given as dry substnace. All chemical additions were made with a mixing speed of 800 rpm in a Britt Dynamic Drainage Jar with a blocked outlet for 45 seconds and the stock systems were then added to the Canadian Freeness Tester. In all tests the sol was added before the polymer.

Different sols were used:

(a) Cationic aluminum modified silica sol with a mole ratio of aluminum to surface silica groups of 1.30:1 and a particle size of about 7.5 nm.

(b) Cationic aluminum modified silica sol with a mole ratio of aluminum to surface silica groups of 2.95:1 and a particle size of about 7 nm.

(c) Cationic aluminum modified silica sol with a mole ratio of aluminum to surface silica groups of 3.25:1 and a particle size of about 6 nm.

(d) Cationic aluminum modified silica sol with a mole ratio of aluminum to surface silica groups of 2.40:1 and a particle size of about 14 nm.

The following cationic polymers were used:

(A) Cationic polyacrylamide, PAM 1, of medium cationicity, sold by Allied Colloids under the name of Percol 292.

(B) Polyethyleneimine, PEI, sold by BASF AG under the name of Polymin.

(C) Cationic polyacrylamide, PAM 2, of low cationicity, sold by Allied Colloids under the name of Percol 140.

In the table below the results of the freeness tests are given in ml CSF. Comparisons with addition of solely the respective cationic polymers are given. A comparison was also made with an anionic aluminum modified silica sol with a particle size of about 5.5 nm.

| Sol/amount kg/ton | Cat. polymer/amount kg/ton | stock pH | CSF ml |
|---|---|---|---|
| a/1.0 | PAM1/0.5 | 4.5 | 560 |
| a/1.0 | PAM1/1.0 | 4.5 | 620 |
| a/1.0 | PAM1/2.0 | 4.5 | 675 |
| b/1.0 | PAM1/0.5 | 4.5 | 540 |
| b/1.0 | PAM1/1.0 | 4.5 | 605 |
| b/1.0 | PAM1/2.0 | 4.5 | 640 |
| c/1.0 | PAM1/0.5 | 4.5 | 565 |
| c/1.0 | PAM1/1.0 | 4.5 | 620 |
| c/1.0 | PAM1/2.0 | 4.5 | 660 |
| d/1.0 | PAM1/0.5 | 4.5 | 530 |
| d/1.0 | PAM1/1.0 | 4.5 | 590 |
| d/1.0 | PAM1/2.0 | 4.5 | 640 |
| — | PAM1/0.5 | 4.5 | 430 |
| — | PAM1/1.0 | 4.5 | 515 |
| — | PAM1/2.0 | 4.5 | 570 |
| Anionic/1.0 | PAM1/0.5 | 4.5 | 305 |
| Anionic/1.0 | PAM1/1.0 | 4.5 | 495 |
| Anionic/1.0 | PAM1/2.0 | 4.5 | 580 |
| a/1.0 | PEI/0.6 | 7.0 | 430 |
| a/1.0 | PEI/1.0 | 7.0 | 470 |
| a/2.0 | PEI/2.0 | 7.0 | 485 |
| — | PEI/0.6 | 7.0 | 350 |
| — | PEI/1.0 | 7.0 | 410 |
| — | PEI/2.0 | 7.0 | 435 |
| a/1.0 | PAM2/0.5 | 4.5 | 555 |
| a/1.0 | PAM2/1.0 | 4.5 | 625 |
| a/1.0 | PAM2/2.0 | 4.5 | 690 |
| — | PAM2/0.5 | 4.5 | 410 |
| — | PAM2/1.0 | 4.5 | 505 |
| — | PAM2/2.0 | 4.5 | 575 |

EXAMPLE 2

In this test the dewatering effect of a system of the cationic aluminum modified silica sol designated as (a) in Example 1 and a polyacrylamide, Percol 292, was measured and a comparison was made with a system of an anionic aluminum modified silica sol, with a particle size of about 5.5 nm, and the polyacrylamide. The stock was made up from groundwood pulp beaten to 130 ml CSF and the pH was adjusted to 5 with $H_2SO_4$. In the tests with the cationic sol this was added to the stock before the polyacrylamide, except in one experiment when the order of dosage was reversed. In the tests with the anionic sol this was added to the stock after the polymer. The added amounts given in kg/ton are calculated as dry chemicals on dry pulp.

| Cationic sol kg/ton | Anionic sol kg/ton | Polyacrylamide kg/ton | CSF ml |
|---|---|---|---|
| — | — | — | 130 |
| — | — | 0.5 | 210 |
| — | — | 1.0 | 230 |
| — | — | 2.0 | 250 |
| — | — | 3.0 | 245 |
| 1.0 | — | 0.25 | 290 |

-continued

| Cationic sol kg/ton | Anionic sol kg/ton | Polyacrylamide kg/ton | CSF ml |
|---|---|---|---|
| 1.0 | — | 0.5 | 325 |
| 1.0 | — | 0.75 | 340 |
| 1.0 | — | 1.0 | 355 |
| 1.0 | — | 2.0 | 360 |
| 1.0 | (reversed dosage order) | 1.0 | 270 |
| 3.0 | — | 0.25 | 330 |
| 3.0 | — | 0.5 | 375 |
| 3.0 | — | 1.0 | 425 |
| 3.0 | — | 2.0 | 405 |
| — | 1.0 | 0.5 | 190 |
| — | 1.0 | 0.75 | 230 |
| — | 1.0 | 1.0 | 255 |
| — | 1.0 | 2.0 | 280 |
| — | 3.0 | 0.5 | 190 |
| — | 3.0 | 1.0 | 240 |
| — | 3.0 | 2.0 | 320 |
| — | 3.0 | 3.0 | 360 |
| — | 3.0 | 4.0 | 350 |

As evident from the table maximum CSF level is reached at a much lower addition of polyacrylamide in the system with the cationic sol, compared with the system with the anionic sol.

EXAMPLE 3

Some different cationic silica sols [(a), (b), (c) and (d)] were used in this example.

Sols (a) and (d) had been prepared according to the following: 19.49 g of a 50% solution of polyaluminum chloride $[Al_2(OH)_5Cl.2H_2O]_x$ was diluted to 200 g. Into this solution 1000 g of a 1% polysilicic acid were pumped slowly during 45 minutes at room temperature. The polymeric silicic acid had been prepared according to the following: Water glass ($Na_2O.3SiO_2$) was diluted with water to a $SiO_2$ content of 5 percent by weight. The aqueous solution was ion exchanged using ion exchange resin Amberlite IR-120 to a pH of 2.3. The specific surface area of the obtained acid polymeric silicic acid was measured by titration according to the method disclosed by Sears in Analytical Chemistry 28 (1956) 1981 and was found to be 1450 $m^2/g$. This polymeric silicic acid which was later treated with polyaluminum chloride consisted of particles of a size of the order of about 1 nm, to some degree aggregated into chains and networks. The obtained cationic silica sol had the following analysis: 0.39% $Al_2O_3$ and 0.84% $SiO_2$ and thus a mole ratio of Al to surface silica of about 1:2. Sol (a) was made from a freshly prepared polysilicic acid and sol (c) from a polysilicic acid which had been aged for 1 day.

Sols (b) and (d) were prepared as follows: 9.75 g of a 50% polyaluminum chloride, $[Al_2(OH)_5Cl.5H_2O]_x$, solution was diluted to 200 g and 1000 g of a 1% polysilicic acid, prepared as described above, were added to the solution. The resulting product had the following analysis: 0.20% $Al_2O_3$ and 0.83% $SiO_2$ and thus a mole ratio Al to surface Si of about 1:4. Sol (b) was made from a freshly prepared polysilicic acid and sol (d) from a polysilicic acid which had been aged for 1 day.

Sols (a) to (d) were used together with a cationic polyacrylamide (PAM) sold under the designation Percol 292 by Allied Colloids in a stock made up from 60% birch sulphate pulp and 40% pine sulphate pulp. The stock further contained 30% calcium carbonate and 1 g/l of $Na_2SO_4.10H_2O$. The pH of the stock was 8.5. The polyacrylamide was added to the stock before the cationic silica sol, except were otherwise indicated. The dewatering was evaluated as disclosed earlier using a Canadian Freeness Tester. The results are given in the following Table.

| PAM kg/ton | Sol;amount kg/ton | CSF ml |
|---|---|---|
| — | — | 390 |
| 0.5 | — | 475 |
| — | (b); 1 | 395 |
| 0.5 | (a); 1 | 595 |
| 0.5 | (b); 1 | 605 |
| 0.5 | (c); 1 | 590 |
| 0.5 | (d); 1 | 600 |
| 0.5 | (b); 1 (reversed dosage order) | 505 |

A comparison was also made with anionic aluminum modified silica sol with a particle size of about 5.5 nm and this, in an amount of 1 kg/ton together with 0.5 kg/ton of PAM gave a CSF of 520.

EXAMPLE 4

Sols (a) and (b) of Example 3 and also sols (e) and (f) were investigated in combination with cationic polyacrylamide for a stock made up from groundwood pulp. Sol (e) had been prepared according to the following: 27.84 g of a 50% solution of polyaluminum chloride $[Al_2(OH)_5Cl.2H_2O]_x$ was diluted to 200 g. 1000 g of a 1% polysilicic acid, as in Example 3, was added to the polyaluminum chloride solution and the obtained product contained 0.56% Al and 0.83% $SiO_2$ and thus had a mole ratio of Al to surface silica of about 1:1.5. Sol (f) had been prepared according to the following: 34.80 g of a 50% polyaluminum chloride, $[Al_2(OH)_5Cl.5H_2O]_x$, solution was diluted to 200 g and 1000 g of a 1% polysilicic acid was added to the solution. The product contained 0.70% $Al_2O_3$ and 0.83% $SiO_2$ and the mole ratio of Al to surface Si thus was about 1:1.2.

The groundwood pulp stock contained 2 g/l of $Na_2SO_4.10H_2O$ and had a pH of 7.0. The dewatering effect was investigated as described earlier. In most cases the cationic polyacrylamide was added to the stock before the addition of the sol, if not reversed dosage order (rdo) has been indicated. The dosage of the cationic polyacrylamide was 1.0 kg/ton which has been found to be the optimum amount for this stock when it was used alone. In the tests it was noted that the water collected from the freeness tester was much more clear when combinations of sol and cationic polyacrylamide were used than when the polyacrylamide was used alone and this is an indication of very good fines retention.

| PAM kg/ton | Sol;amount kg/ton | CSF ml |
|---|---|---|
| — | — | 120 |
| 1.0 | — | 195 |
| — | (b); 1.0 | 120 |
| 1.0 | (a); 1.0 | 400 |
| 1.0 | (a); 1.5 | 445 |
| 1.0 | (a); 2.0 | 485 |
| 1.0 | (a); 2.5 | 510 |
| 1.0 | (a); 1,0 (rdo) | 330 |
| 1.0 | (a); 1.5 (rdo) | 345 |
| 1.0 | (a); 2.0 (rdo) | 355 |
| 1.0 | (a); 2.5 (rdo) | 360 |
| 1.0 | (b); 1.0 | 420 |
| 1.0 | (b); 1.5 | 480 |
| 1.0 | (b); 2.0 | 505 |
| 1.0 | (b); 2.5 | 530 |
| 1.0 | (e); 1.5 | 400 |

-continued

| PAM kg/ton | Sol;amount kg/ton | CSF ml |
|---|---|---|
| 1.0 | (e); 2.0 | 440 |
| 1.0 | (e); 2.5 | 435 |
| 1.0 | (f); 1.5 | 390 |
| 1.0 | (f); 2.0 | 425 |
| 1.0 | (f); 2.5 | 435 |

EXAMPLE 5

In this example the filler and fines retention was evaluated in a mill test. The stock was made up from 30% of chemical pulp, 24% of groundwood pulp and 46% of $CaCO_3$ filler. The concentration of the stock was 0.5% and the pH was 8.3. The measured fillers and fines content was 76.9%.

A Britt Dynamic Drainage Jar was used to evaluate retention. The stirrer speed was set to 800 rpm and the wire used was of 200 mesh.

The cationic silica sol used was sol (a) according to Example 1 and this was added before the cationic retention agent. The following cationic retention agents were used in the different runs:

(A) Cationic polyacrylamide, Percol 292 manufactured by Allied Colloids.

(B) Cationic guar gum.

The results of the tests are shown in the table below. The filler and fines retention (FF ret.) is given in percent at different dosages of the respective cationic polymers. The dosage is calculated as dry polymer on dry pulp plus filler. The cationic silica sol was used in an amount of 1 kg/ton of dry pulp filler. Comparisons were made with addition of solely the cationic polymer.

| Added cationic polymer | Added amount kg/ton | Added sol kg/ton | FF ret. % |
|---|---|---|---|
| A | 0.25 | 1 | 75 |
| A | 0.50 | 1 | 97 |
| A | 0.75 | 1 | 100 |
| A | 0.25 | — | 43 |
| A | 0.50 | — | 61 |
| A | 0.75 | — | 80 |
| B | 2 | 1 | 95 |
| B | 4 | 1 | 95 |
| B | 6 | 1 | 95 |
| B | 2 | — | 45 |
| B | 4 | — | 83 |
| B | 6 | — | 90 |

EXAMPLE 6

In this example the system of a cationic silica sol (a) according to Example 1 and cationic polyacrylamide, was tested in a mill producing magazine paper. The stock consisted of 19% sulphate pulp, 37% groundwood pulp, 20% thermomechanical pulp and 24% clay, i.e. a stock with high amounts of non-cellulosic substances. The pH was 4.45. Retention was measured with a Britt Dynamic Drainage Jar and freeness with a Canadian Freeness Tester.

| Additions Sol | kg/ton PAM | Retention % | Freeness ml |
|---|---|---|---|
| — | 0.25 | 26.4 | 110 |
| — | 0.50 | 44.6 | 140 |
| — | 1.0 | 57.6 | 190 |

-continued

| Additions Sol | kg/ton PAM | Retention % | Freeness ml |
|---|---|---|---|
| 2.0 | 0.25 | 41.7 | 150 |
| 2.0 | 0.50 | 65.0 | 200 |
| 2.0 | 1.0 | 85.6 | 305 |

I claim:

1. A process for the production of paper, by forming and dewatering a suspension of cellulose containing fibers and optionally fillers on a wire, with improved retention and dewatering, characterized in that the forming and dewatering takes place in the presence of a cationic silica based sol and a cationic polymeric retention agent selected from the group consisting of cationic guar gum and synthetic cationic polymers wherein the weight ratio of said cationic retention agent to cationic silica particles is at least 0.01:1.

2. A process according to claim 1, characterized in that the cationic silica sol particles are aluminum modified silica particles.

3. A process according to claim 1 or 2, characterized in that the cationic silica particles have particle sizes within the range of from 2 nm to 100 nm.

4. A process according to claim 1, characterized in that the cationic polymeric retention agent is a synthetic cationic polymer.

5. A process according to claim 4, characterized in that the cationic polymeric retention agent is cationic polyacrylamide.

6. A process according to claim 1, characterized in that the amount of cationic silica sol is within the range of from 0.005 to 2.0 percent by weight, calculated as dry on dry fibers and optional fillers.

7. A process according to claim 1, characterized in that the weight ratio of cationic retention agent to cationic silica is at least 0.2:1.

* * * * *